US012235041B2

(12) United States Patent
Jakobsen et al.

(10) Patent No.: US 12,235,041 B2
(45) Date of Patent: Feb. 25, 2025

(54) APPARATUS FOR BEVERAGE CONTAINER TEMPERATURE CONTROL

(71) Applicant: Grad ApS, Copenhagen (DK)

(72) Inventors: Kenneth Holck Jakobsen, Solrød Strand (DK); Anders Bruus, Copenhagen (DK); Michael Skovbjerg, Copenhagen (DK); Ann-Marie Finn, Copenhagen (DK)

(73) Assignee: Grad ApS, Copenhagen (DK)

( * ) Notice: Subject to any disclaimer, the term of this patent is extended or adjusted under 35 U.S.C. 154(b) by 0 days.

(21) Appl. No.: 17/751,745

(22) Filed: May 24, 2022

(65) Prior Publication Data

US 2022/0381508 A1 Dec. 1, 2022

Related U.S. Application Data

(60) Provisional application No. 63/194,275, filed on May 28, 2021.

(51) Int. Cl.

| | |
|---|---|
| ***F25D 31/00*** | (2006.01) |
| ***A47G 23/02*** | (2006.01) |
| ***F25D 3/08*** | (2006.01) |

(52) U.S. Cl.

CPC ..... *F25D 31/002* (2013.01); *A47G 23/02* (2013.01); *F25D 3/08* (2013.01); *A47G 2023/0283* (2013.01); *F25D 2331/808* (2013.01)

(58) Field of Classification Search

CPC ..... F25D 31/007; F25D 2331/803; F25D 31/006–31/008; F25D 31/002; F25D 3/08; F25D 2331/808; A47G 23/02; A47G 2023/0275; A47G 2023/0283

See application file for complete search history.

(56) References Cited

U.S. PATENT DOCUMENTS

| | | | |
|---|---|---|---|
| 4,164,851 | A | 8/1979 | Bryant |
| 4,681,611 | A | 7/1987 | Bohner |
| 4,704,872 | A | 11/1987 | Jones |
| 4,823,554 | A | 4/1989 | Trachtenberg et al. |
| 4,891,949 | A | 1/1990 | Caldarola |
| 4,913,713 | A | 4/1990 | Bender et al. |
| 5,029,446 | A | 7/1991 | Suzuki |

(Continued)

FOREIGN PATENT DOCUMENTS

| | | |
|---|---|---|
| AU | 2005101069 | 2/2006 |
| CN | 201548014 U | 8/2010 |

(Continued)

OTHER PUBLICATIONS

English language translation of KR 10-20200006670 to Kim. Translated Nov. 2023 (Year: 2020).*

(Continued)

*Primary Examiner* — Cassey D Bauer

(74) *Attorney, Agent, or Firm* — DiBerardino McGovern IP Group LLC

(57) ABSTRACT

Apparatus for controlling the temperature of a beverage container, for example, by either chilling the beverage container or maintaining the beverage container at a predetermined temperature, the apparatus having a generally cylindrical configuration with a receptacle in its upper portion and cooling components in the lower portion to establish a low center of gravity for the apparatus.

18 Claims, 8 Drawing Sheets

(56) References Cited

U.S. PATENT DOCUMENTS

| | | | | |
|---|---|---|---|---|
| 5,409,547 | A | 4/1995 | Watanabe et al. | |
| 5,634,343 | A | 6/1997 | Baker | |
| 5,720,171 | A | 2/1998 | Osterhoff et al. | |
| 5,862,669 | A | 1/1999 | Davis et al. | |
| 6,003,318 | A | 12/1999 | Busick et al. | |
| 6,096,032 | A | 8/2000 | Rowland | |
| 6,119,461 | A | 9/2000 | Stevick et al. | |
| 6,141,969 | A | 11/2000 | Launchbury et al. | |
| 6,338,252 | B1 | 1/2002 | Calderaio | |
| 6,351,964 | B1 | 3/2002 | Brancheau | |
| 6,640,551 | B1 | 11/2003 | Slone et al. | |
| 6,732,533 | B1 | 5/2004 | Giles | |
| 7,089,749 | B1 | 8/2006 | Schafer | |
| 7,334,414 | B2 | 2/2008 | Park et al. | |
| 7,934,384 | B2 | 5/2011 | Tuszkiewicz et al. | |
| 8,397,519 | B2 | 3/2013 | Loibl et al. | |
| 8,468,836 | B2 | 6/2013 | Tuszkiewicz et al. | |
| 8,512,430 | B2 | 8/2013 | Manahan et al. | |
| 8,727,179 | B2 | 5/2014 | Colelli et al. | |
| 9,752,808 | B2 | 9/2017 | Nakamura et al. | |
| 9,975,462 | B2 | 5/2018 | Doi | |
| 10,113,791 | B2 | 10/2018 | Wenji et al. | |
| 2003/0031777 | A1 | 2/2003 | Lucatello | |
| 2004/0035119 | A1 | 2/2004 | Slone et al. | |
| 2005/0274119 | A1 | 12/2005 | Lee | |
| 2006/0117760 | A1 | 6/2006 | Pieronczyk et al. | |
| 2006/0188418 | A1 | 8/2006 | Park et al. | |
| 2006/0218937 | A1 | 10/2006 | Park et al. | |
| 2006/0260324 | A1 | 11/2006 | Luzaich | |
| 2007/0193280 | A1 | 8/2007 | Tuszkiewicz et al. | |
| 2008/0148753 | A1 | 6/2008 | Welker et al. | |
| 2010/0058776 | A1 | 3/2010 | Loibl et al. | |
| 2010/0115969 | A1 | 5/2010 | Tuszkiewicz et al. | |
| 2010/0115986 | A1 | 5/2010 | Wang | |
| 2010/0258268 | A1 | 10/2010 | Li | |
| 2011/0011099 | A1 | 1/2011 | Linder | |
| 2012/0093650 | A1* | 4/2012 | Huber | F04D 29/662 416/144 |
| 2012/0217772 | A1 | 8/2012 | Tang | |
| 2012/0266609 | A1 | 10/2012 | Liu et al. | |
| 2014/0069111 | A1 | 3/2014 | Campbell et al. | |
| 2014/0157794 | A1 | 6/2014 | McGann | |
| 2014/0165621 | A1 | 6/2014 | Boarman et al. | |
| 2014/0190185 | A1 | 7/2014 | Bell et al. | |
| 2015/0230631 | A1 | 8/2015 | Nuttall et al. | |
| 2015/0245723 | A1 | 9/2015 | Alexander | |
| 2015/0273560 | A1 | 10/2015 | Pilon et al. | |
| 2015/0323246 | A1 | 11/2015 | Spivey et al. | |
| 2016/0018115 | A1 | 1/2016 | Arjomand | |
| 2016/0018138 | A1 | 1/2016 | Liptak et al. | |
| 2016/0236605 | A1 | 8/2016 | Doi | |
| 2016/0281039 | A1 | 9/2016 | Narasimhan et al. | |
| 2016/0282040 | A1 | 9/2016 | Wenji et al. | |
| 2017/0102181 | A1 | 4/2017 | Arjona Esteves | |
| 2017/0113870 | A1 | 4/2017 | Looker | |
| 2017/0314851 | A1* | 11/2017 | Alexander | G06Q 20/327 |
| 2017/0356686 | A1 | 12/2017 | Xue et al. | |
| 2018/0040795 | A1 | 2/2018 | Lam et al. | |
| 2018/0087812 | A1* | 3/2018 | Armstrong | F25B 21/04 |
| 2018/0105410 | A1 | 4/2018 | Kim et al. | |
| 2018/0106533 | A1 | 4/2018 | Lauchnor | |
| 2018/0164034 | A1 | 6/2018 | Banks | |
| 2018/0235392 | A1 | 8/2018 | Yuki et al. | |
| 2018/0240229 | A1* | 8/2018 | Yuki | G06T 7/0004 |
| 2018/0252446 | A1 | 9/2018 | Place | |
| 2019/0154313 | A1 | 5/2019 | Verellen | |
| 2020/0224964 | A1* | 7/2020 | Alexander | F25D 11/003 |
| 2021/0063081 | A1 | 3/2021 | Tachibana et al. | |

FOREIGN PATENT DOCUMENTS

| | | | | | |
|---|---|---|---|---|---|
| CN | 105466152 | | | 4/2016 | |
| CN | 106679331 | | * | 5/2017 | F25D 31/007 |
| CN | 106679331 | A | | 5/2017 | |
| DE | 102006021459 | A1 | | 11/2007 | |
| EP | 3301381 | A1 | | 4/2018 | |
| EP | 2426575 | B1 | * | 9/2018 | G06F 1/20 |
| FR | 2900724 | A1 | | 11/2007 | |
| JP | 2001041630 | A | | 2/2001 | |
| JP | 2003106728 | | | 4/2003 | |
| JP | 2004212029 | A | | 7/2004 | |
| KR | 20130097920 | A | | 9/2013 | |
| KR | 10-20200006670 | | * | 1/2020 | F25D 31/007 |
| KR | 1020200006670 | A | | 1/2020 | |
| WO | 2011150018 | A1 | | 12/2011 | |
| WO | 2017137774 | A2 | | 8/2017 | |
| WO | WO2017137774 | | * | 8/2017 | F25D 31/007 |
| WO | 2020055553 | A1 | | 3/2020 | |
| WO | 2021096807 | A1 | | 5/2021 | |

OTHER PUBLICATIONS

English language translation of CN 106679331 to Cao. Translated Nov. 2023 (Year: 2017).*

English language translation of EP2426575 to Huang et al. Translated Mar. 2024 (Year: 2018).*

Henrik Mensing, Danish International Searching Authority, International Search Report and Written Opinion, counterpart PCT Application No. PCT/DK2022/050115, mailed Aug. 23, 2022, 19 pages total.

Ferrotec. (Nov. 13, 2008). Ferrotec Multi-stage Deep Cooling Peltier Thermoelectric Cooler Modules. Retrieved Aug. 2, 2019, from https://thermal.ferrotec.com/products/peltier-thermoelectric-cooler-modules/deep-cooling/ (Year: 2008).

Fargo Controls, Inc. (Nov. 6, 2008). Operating Principles for Inductive Proximity Sensors. Retrieved Aug. 2, 2019, from https://www.fargocontrols.com/sensors/inductive_op.html (Year: 2008).

* cited by examiner

APPARATUS FOR BEVERAGE CONTAINER TEMPERATURE CONTROL

CROSS-REFERENCE TO RELATED APPLICATIONS

This application claims the benefit of U.S. Provisional Application No. 63/194,275, filed May 28, 2021, which is incorporated by reference herein in its entirety.

FIELD

The present disclosure relates to devices for controlling the temperature of containers for beverages. More particularly this disclosure pertains to devices for chilling a container having a beverage inside or for maintaining such a container at a suitable temperature.

BACKGROUND

One important consideration in the enjoyment of beverages such as wine, beer, and soft drinks is the temperature of the beverage when it is being imbibed. There are numerous devices and systems for cooling a beverage or maintaining a beverage at a cool temperature so that it is ready for consumption at the proper temperature. These devices range from the extremely simple to the more sophisticated. In general, it is desirable to have a device or system which is portable, cools relatively quickly, and is lightweight. For devices that run on electricity, is desirable to have a relatively low power consumption especially if is desired for the unit to be portable and capable of running on a portable power source such as batteries.

With all of this taken into account, there is a need for a beverage cooler which is portable and has relatively low power consumption.

SUMMARY

The following presents a simplified summary of one or more embodiments in order to provide a basic understanding of the embodiments. This summary is not an extensive overview of all contemplated embodiments and is not intended to identify key or critical elements of all embodiments nor set limits on the scope of any or all embodiments. Its sole purpose is to present some concepts of one or more embodiments in a simplified form as a prelude to the more detailed description that is presented later.

According to one aspect, there is disclosed an apparatus for controlling a temperature of a beverage container, the apparatus comprising a cylindrical housing having an upper portion and a lower portion, the upper portion including a cylindrical receptacle adapted to receive the beverage container, a thermoelectric element positioned in the lower portion, the thermoelectric element having a first side at a first temperature and a second side at a second temperature lower than the first temperature, the second side being in thermal communication with the receptacle, a heat sink in thermal communication with the first side, and at least one battery positioned in the lower portion and electrically connected to the thermoelectric element to provide power to the thermoelectric element.

Further embodiments, features, and advantages of the subject matter of the present disclosure, as well as the structure and operation of the various embodiments are described in detail below with reference to accompanying drawings.

BRIEF DESCRIPTION OF THE DRAWINGS

The accompanying drawings, which are incorporated herein and form part of the specification, illustrate the methods and systems of embodiments of the invention by way of example, and not by way of limitation. Together with the detailed description, the drawings further serve to explain the principles of and to enable a person skilled in the relevant art(s) to make and use the methods and systems presented herein. In the drawings, like reference numbers indicate identical or functionally similar elements.

Figure 1:
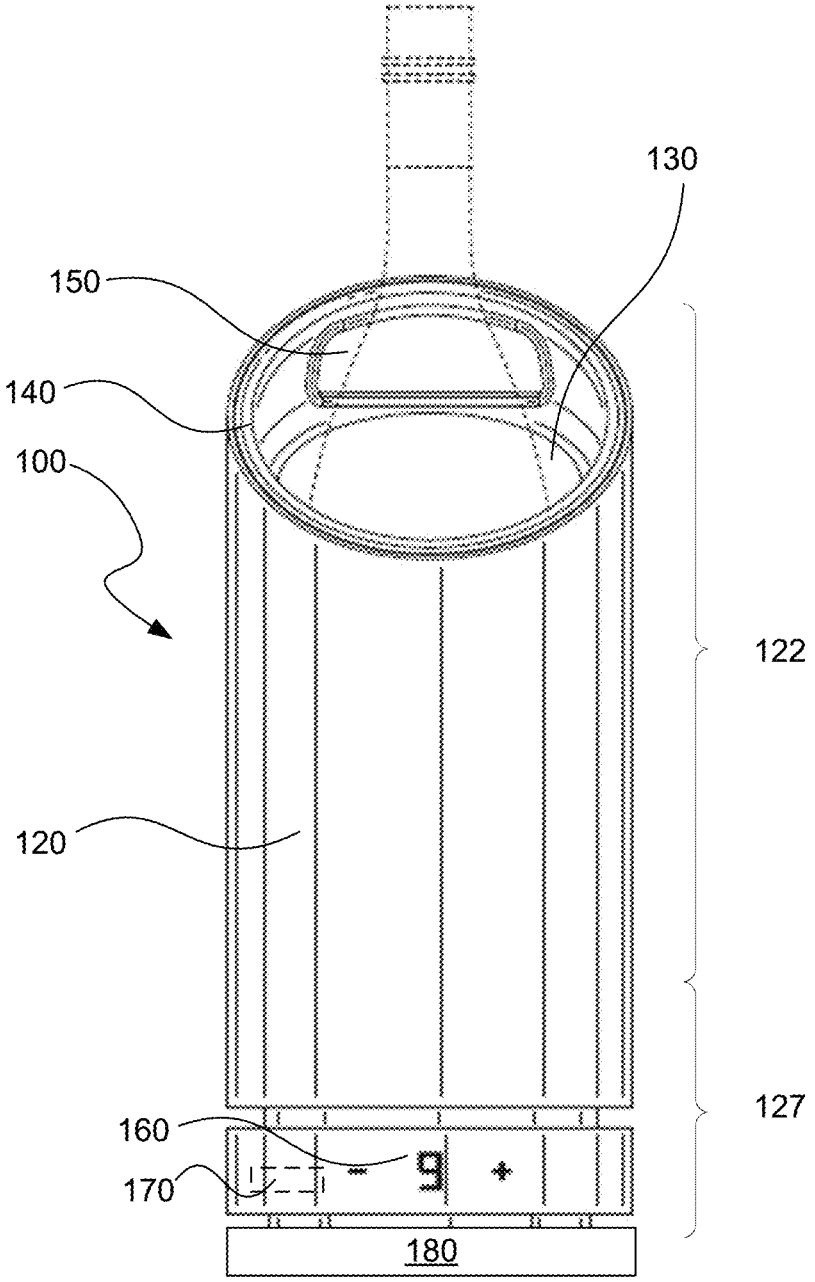
FIG. 1 is a perspective view of a beverage container temperature control system according to one aspect of an embodiment.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

DETAILED DESCRIPTION

Various embodiments are now described with reference to the drawings, wherein like reference numerals are used to refer to like elements throughout. In the following description, for purposes of explanation, numerous specific details are set forth in order to promote a thorough understanding of one or more embodiments. It may be evident in some or all instances, however, that any embodiment described below can be practiced without adopting the specific design details described below. In other instances, well-known structures and devices are shown in block diagram form in order to facilitate description of one or more embodiments.

The embodiment(s) described, and references in the specification to "one embodiment," "an embodiment," "an example embodiment," "an exemplary embodiment," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

With respect to FIG. 1, there is shown a beverage container temperature control system 100 which includes a housing 120. An upper portion 122 of the housing 120 defines a beverage container receptacle 130. As can be seen, according to an aspect of an embodiment, the housing 120 is generally cylindrical with the cylinder being truncated with a slanted rim at the top. The slanted rim 140 defines a beverage container insertion port. The slanted rim 140 makes it easier to insert a beverage container into, and remove a beverage container from, the beverage container receptacle 130. The beverage receptacle may be made of a thermally conductive material such as aluminum.

The slanted rim 140 creates a geometry in which a front portion of the housing 120 and receptacle 130 are lower than a rear portion of the housing 120 and the receptacle 130. The rear portion of the housing 120 below the higher portion of the slanted rim 140 includes an aperture 150 serving as an integral handle. This geometry also permits active cooling of more surface area of the beverage container, in particular, the portion of the beverage container adjacent the rear portion of the receptacle 130 while simultaneously obtaining the aesthetic benefit of displaying more of the from of the beverage container.

The lower part or base 127 of the housing 120 contains electrical and electronic components for controlling a temperature in the beverage container receptacle 130. As will be explained more fully below, positioning these components in the base of the housing 120 makes the system 100 less likely to topple by lowering its center of gravity. According to an aspect of an embodiment, the lower part 127 of the housing 120 may also include a display 160 for displaying a temperature which may be a set temperature or an actual temperature. A control 170 such as a slide switch, shown in phantom as it may not be visible, may be included for setting a temperature. FIG. 1 also shows a charging base 180 described in more detail below which is provided to charge batteries in the lower portion 127.

Figure 2:
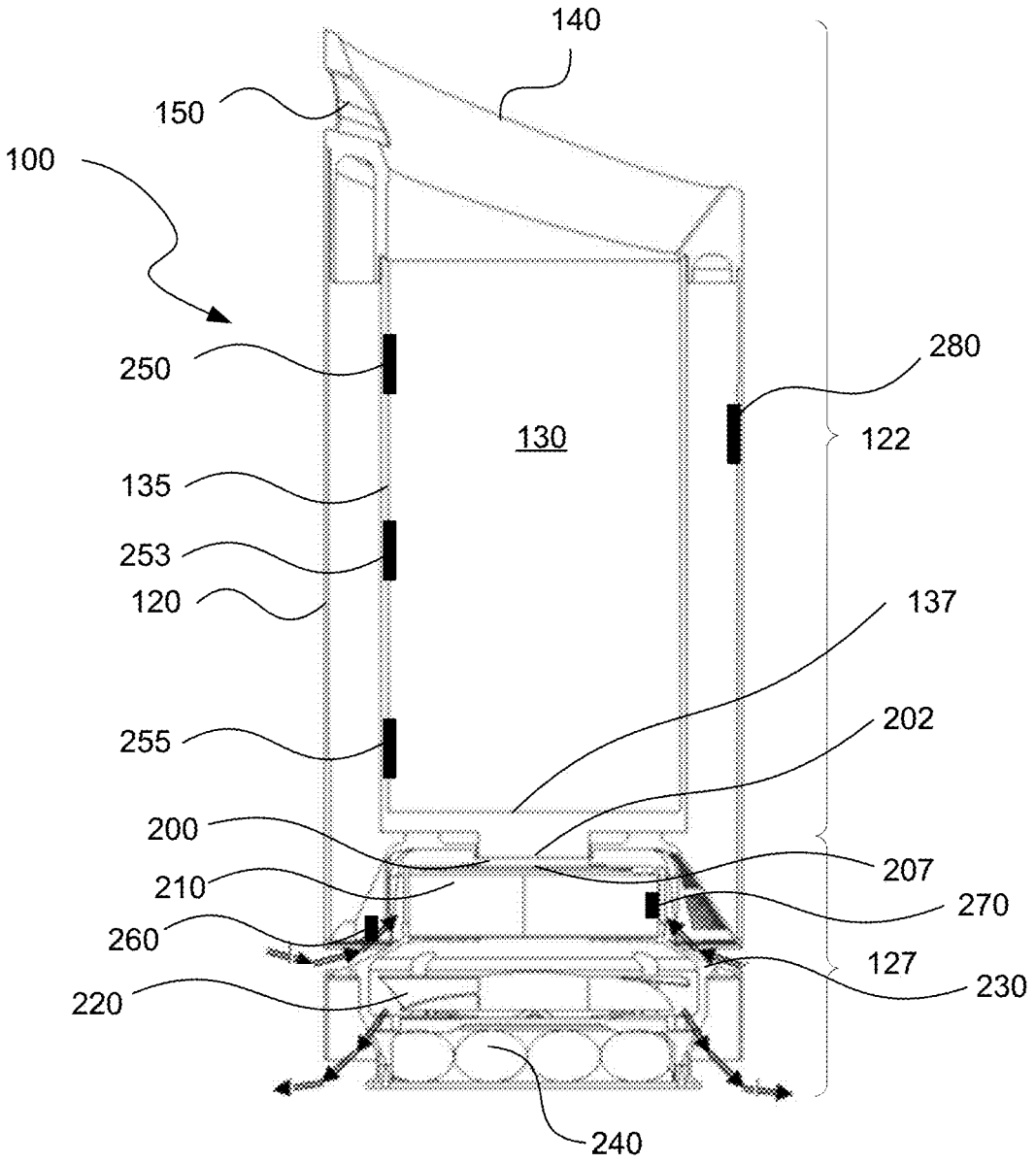
FIG. 2 is a cutaway view of a beverage container temperature control system according to one aspect of an embodiment.

FIG. 2 is a cutaway view of the beverage container temperature control system 100 of FIG. 1. As can be seen, the housing 120 surrounds the interior receptacle 130. As described below, the wall 135 of the receptacle 130 serves as a cold sink for a temperature control element 200. The temperature control element 200 may be a cooling element, and, more specifically, a thermoelectric cooler such as a Peltier element. Using a Peltier element as an example, the temperature control element 200 has a cold side 202 and a hot side 207. The cold side 202 of the temperature control element 200 is in thermal contact with the bottom surface 137 of the receptacle 130 which, as mentioned, with the integral wall 135 functions as a cold sink for the temperature control element 200. The hot side 207 of the temperature control element 200 is in thermal communication with a heat sink 210. The heat sink 210 is cooled by an air flow indicated by the inflowing arrows. The air flows through the front and back of the heat sink 210 then exits the compartment containing the heat sink 210 as indicated by the outward flowing arrows. The air is driven by a fan 220. A parting wall 230 separates the area where intake air is drawn in and the area where hot air is expelled. Also shown in FIG. 2, a portable power source 240, for example, battery cells, supplies power to the fan 220 and to the temperature control element 200. The unit may also include, for example in the fan compartment, provision for gyroscopic stabilization. In some embodiments the fan 220 itself may be adapted to provide some degree of gyroscopic stabilization, for example, by the weight distribution of the fan blades.

FIG. 2 also shows possible locations for various sensors that may be provided in an embodiment. For example, a sensor 250 may be used to sense a temperature of the beverage container receptacle 130 at an upper location. A sensor 253 may be provided to sense a temperature in the beverage container receptacle 130 at a mid-level location. A sensor 255 may be provided to sense the temperature of the beverage container receptacle 130 at or near the bottom of the beverage container receptacle 130. In addition, a sensor 280 may be provided to sense the temperature of the incoming ambient air to the heat sink 210. A sensor 280 may be provided on the housing 120 to measure ambient temperature, humidity, light intensity, wind speed, and atmospheric pressure. In an embodiment, the sensor 250 may also be configured to sense the presence of a beverage container in the beverage container receptacle 130.

Figure 3:
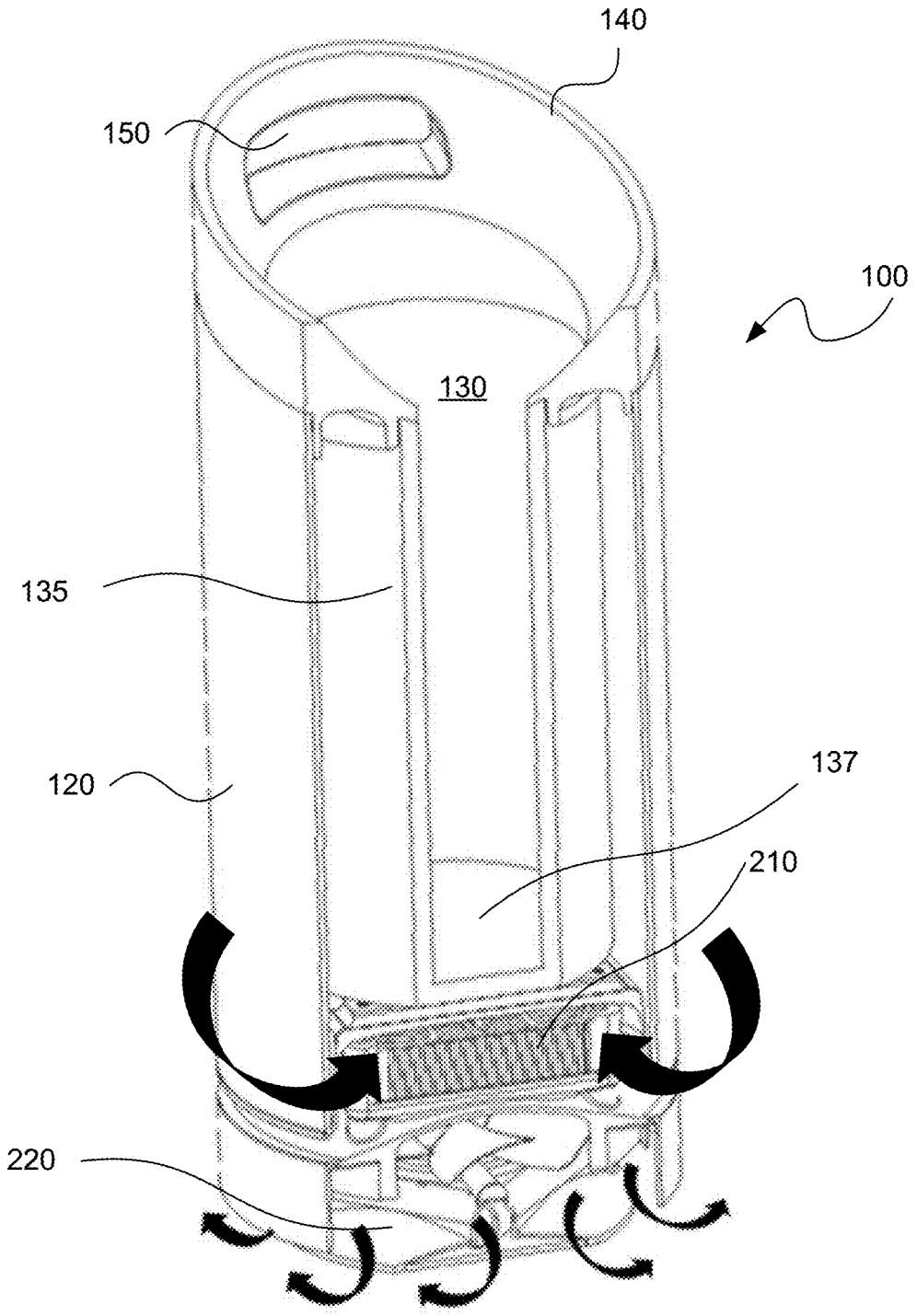
FIG. 3 is a partially cutaway perspective view of a beverage container temperature control system according to one aspect of an embodiment.

FIG. 3 is a partially cutaway perspective view of the beverage container temperature control system 100. As can be seen, according to an aspect of an embodiment, warm air is expelled downward from the fan 220 in a 360° ring as indicated by the outflowing arrows Ambient air is drawn in through the front and rear of the heatsink 210 as indicated by the inflowing arrows. Also better visible in FIG. 3 is the wall 135 of receptacle 130 including base wall 137 of receptacle 130. As mentioned, these walls may be made of a thermally conductive material such as aluminum.

Figure 4:
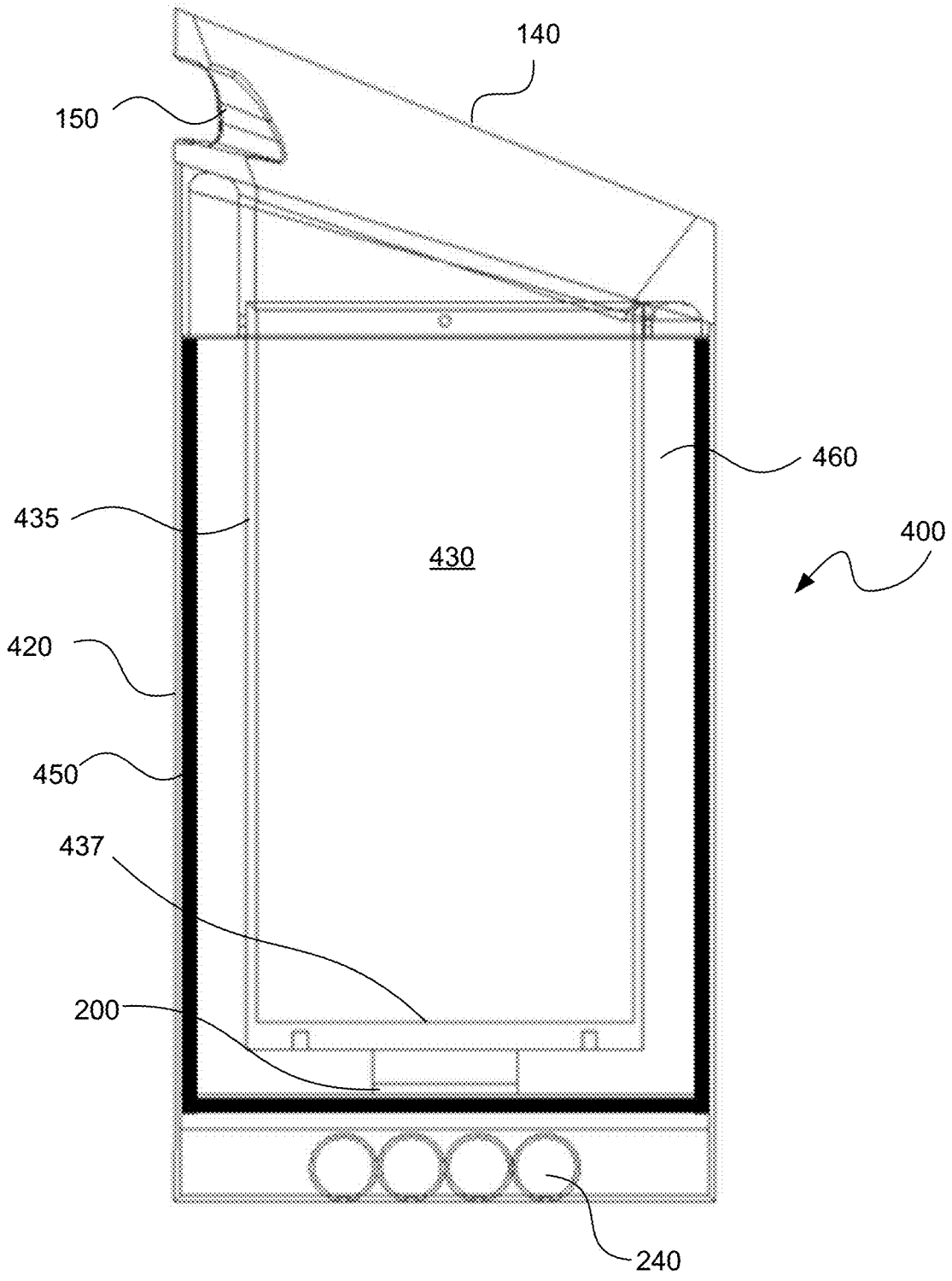
FIG. 4 is another cutaway view of a beverage container temperature control system according to one aspect of an embodiment.

FIG. 4 is a cutaway sideview of a beverage container temperature control system 400 according to another aspect of an embodiment. In order to avoid the power drain caused by a fan, and also to avoid noise and vibration which may be caused by a fan, the embodiment of FIG. 4 avoids the use of a fan by employing the housing 420 as a heat sink. The cold side of the Peltier unit 200 is in direct thermal communication with the bottom wall 437 and side wall 435 of the container receptacle 430. The hot side of the Peltier unit 200 is in thermal contact with a heat sink made up at least in part by the housing 420. Heat pipes 450 can be used in thermal contact with housing 420 to provide better heat transfer. A vacuum chamber 460 may be interposed between the walls of the container receptacle 430 in the housing 420 to provide thermal insulation between the heat sink in the cold sink. A phase change material may be placed in the space between the walls of the container receptacle 430 in the housing 420 to provide thermal insulation between the heat sink in the cold sink.

Figure 5A:
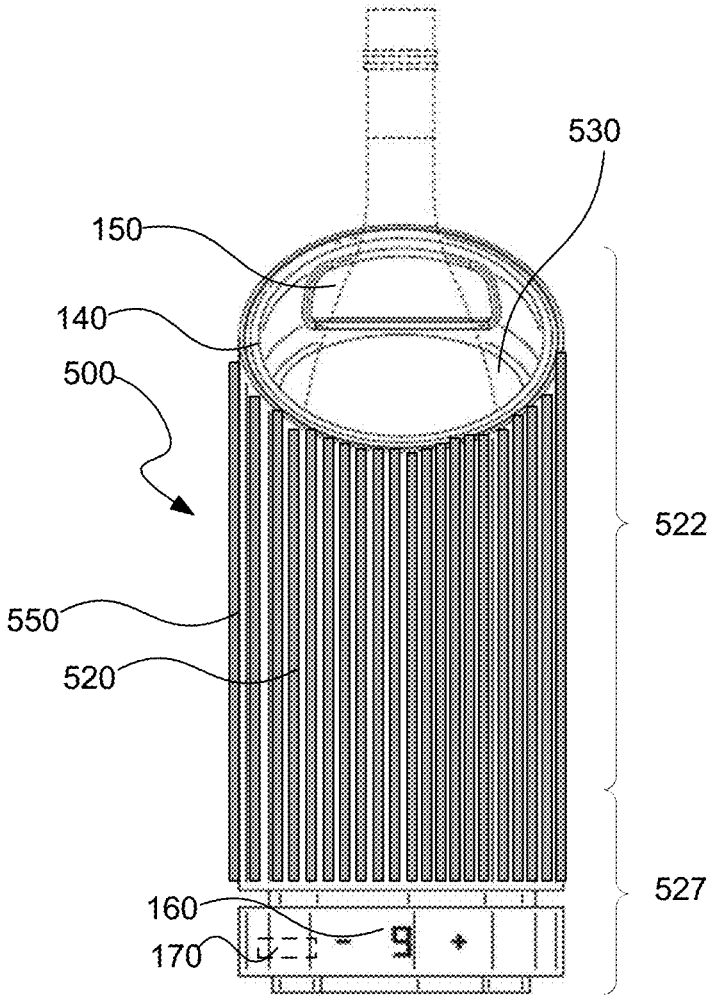
FIG. 5A is another cutaway view of a beverage container temperature control system according to one aspect of an embodiment.
Figure 5B:
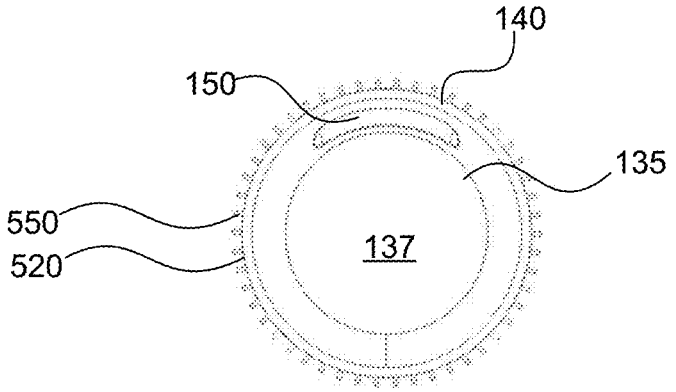
FIG. 5B is a top view of the embodiment of FIG. 5A.

FIGS. 5A and 5B show a beverage container temperature control system 500 in accordance with another aspect of an embodiment. FIG. 5A is a front view of the beverage container temperature control system 500. As can be seen, the outer housing 520 of the beverage container temperature control system 500 is provided with a set of fins 550 to promote heat radiating away from the outer housing 520. Such an implementation may be particularly advantageous in embodiments which a fan is not used and the outer housing 520 is used as a heat sink. FIG. 5B is a top view of the embodiment of FIG. 5A. As can be seen, in an embodiment the fins are arranged as elongated elements positioned parallel to an axis of the cylindrical housing.

Figure 6:
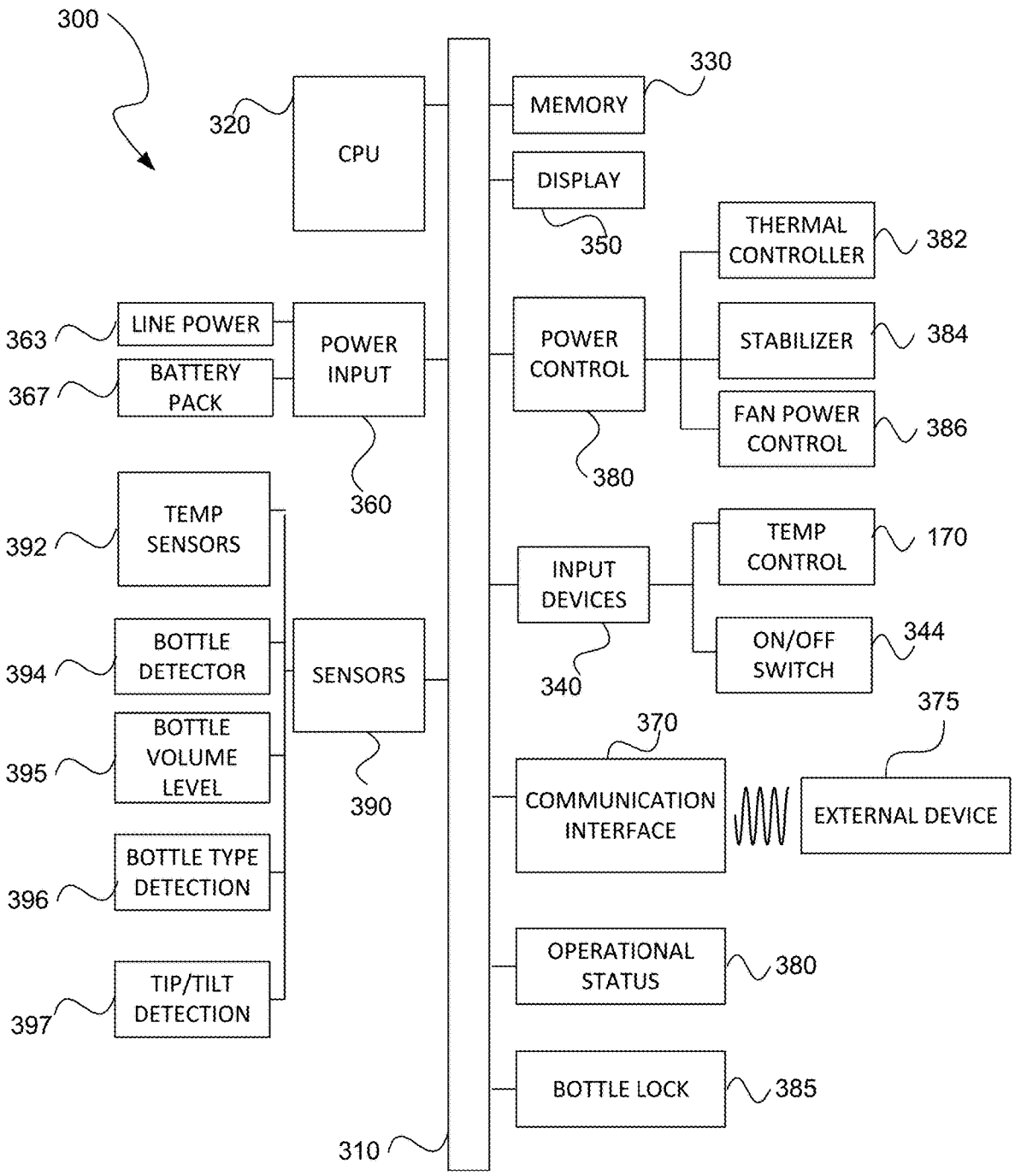
FIG. 6 is a circuit block diagram of a control system for a beverage container temperature control system according to one aspect of an embodiment.

The various sensors described above make up part of an overall control system 300, one possible arrangement for which is included in the functional block diagram shown in FIG. 6. As shown, the control system 300 may include a suitably programmed CPU 320 and a memory 330 for storing instructions and data connected to one another by a bus 310. The control system 300 may also include input devices 340 which may include one or more switches or controllers, temperature control switch 170 (FIG. 1) as well as a physical on/off switch 344. The control system 300 may also include sensors 390 which may include temperature sensors 392 which in turn may include temperature sensors 250, 253, 255, 269, 270, and 280 (FIG. 2). The sensors 390 may also include a bottle detector 395 for detecting the physical presence of a bottle in the receptacle, a bottle volume level detector 395 which detects how much beverage is still in the bottle, a bottle type detection sensor 396 which can read the barcode on the bottle to determine what type of beverage is in the bottle and a tip tilt detection sensor 397 which can detect when the unit is tipping or tilting. The control system 300 may also include an operational status module 380 which determines the operational status of the unit and a bottle lock module 385 which can control a bottle lock to lock the bottle in place in receptacle when, for example, the unit is being transported with a bottle inside of it.

The communication interface 370 may include any device for communicating data to or from the CPU 320 and an outside device. For example, the communications interface 370 may include a USB interface and/or or an Ethernet interface. The communications interface 370 may additionally or alternately include a wireless interface such as a WiFi, Bluetooth, or an NFC interface.

A user interface can be implemented as software operating on a computer or as an application on a smart phone or tablet or other wireless communication device. To implement this, the communications interface 370 could be configured to interface with an external device 375 such as a wireless enabled device such as a computer, tablet, or cell phone. The user could use an application on the mobile device to control operation of the beverage container temperature control system. If the external device 375 is a wireless enabled device such as a computer, tablet, or cell phone, an application could be installed on the external device 375 and the user interface for the application could, for example, be a visual representation of a display with controls.

The control system 300 may also include various power control units 380 such as a thermal controller power control unit 382. The thermal controller power control units may use pulse width modulated control of the thermal controllers in which a duty cycle of pulses is used to control the average power supplied to the thermal controllers. The power controller 380 may also a control 384 for a gyroscopic stabilizer if one is present. The power controller 380 may also include a fan power control 386 electrically connected to control operation of the fan assembly 220. The thermal controller 382 may also include provision for reversing the polarity of the thermal control element 200 so that it heats rather than cools or vice versa. This could be useful if an excess amount of ice accumulates at the receptacle 130 which may interfere with operation or even cause a bottle to become trapped in the receptacle 130.

The sensor 395 for sensing an amount or level of liquid in a bottle inserted into the receptacle 130 may operate optically or by determining net weight, for example for measuring usage patterns. The bottle level may be indicated by an indicator, for example, a column of LEDs illuminated up to the same level as the sensed level in the bottle, or may be relayed to be read remotely, e.g., by Bluetooth or Wi-Fi to a control device such as a smart phone running an app.

The input devices 340 may include a touch screen or any other manual user interface devices used for controlling operation of beverage container temperature control system. Also connected by the bus 310 may be one or more displays 350 which may include, for example, the temperature display 160 (FIG. 1) which may be toggled between a set temperature and a measured temperature. The displays 350 may include more complicated visual displays such as a small screen which may be a touch screen.

The CPU 320 is also capable of selecting between multiple power inputs through a power input unit 360 which, for example, may be connected to line power 363 or a battery pack 367.

As mentioned, the CPU 320 may also be connected by the bus 310 to an operational status sensor 380 to determine, for example, operational temperature, an amount of time the device has been operated for purposes of scheduling maintenance or remaining battery life, and so on.

Figure 7A:
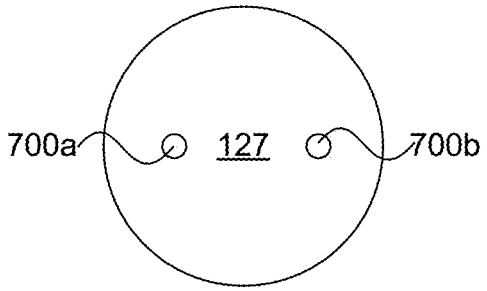
FIG. 7A is a bottom view of a beverage container temperature control system according to one aspect of an embodiment.
Figure 7B:
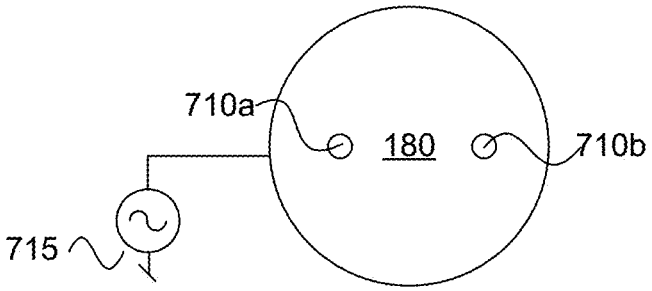
FIG. 7B is a top view of a charging base for a beverage container temperature control system according to one aspect of an embodiment.
Figure 7C:
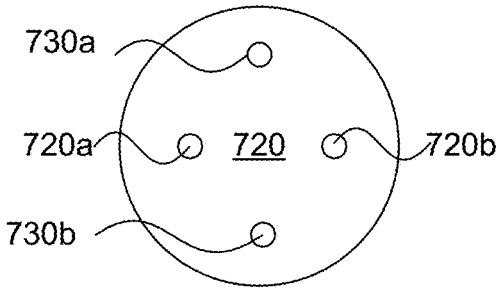
FIG. 7C is a top view of a battery pack for a beverage container temperature control system according to one aspect of an embodiment.

FIG. 7A is a bottom view the lower portion 127 of the beverage container temperature control system 100. As can be seen, the bottom surface of the lower portion 127 is provided with two contacts 700*a* and 700*b*. These are made of an electrically conductive material and are in electrical connection with circuitry inside of the unit for charging the batteries located in the lower portion 127. These contacts are preferably recessed slightly from the bottom surface of the lower portion 127 so as not interfere with the unit resting stably on a horizontal surface. FIG. 7B is a schematic diagram of the top view of a charging station or plate 180 for the beverage container temperature control system 100. The charging plate 180 has two contacts 710*a* and 710*b* positioned to mate with the contacts 700*a* and 700*b* in the bottom surface of the lower portion 127. The charging plate 180 contains circuitry needed to provide battery charging. It is intended to be connected to a source of line power 715. As an alternative, in accordance with an aspect of embodiment, the beverage temperature control unit 100 may include circuitry for contactless or inductive charging and which case the charging plate 180 would be configured for contactless or inductive charging. FIG. 7C is a diagram of a supplemental battery pack 720 with contacts 720*a* and 720*b* which mate with 700*a* and 700*b* to provide supplemental or auxiliary battery power for the beverage container temperature control unit 100. The supplemental battery pack 720 also contains contacts 730*a* and 730*b* intended to mate with contacts 710*a* and 710*b* in the charging plate 180 so that the charging plate 180 can charge the supplemental battery pack 720.

Figure 8:
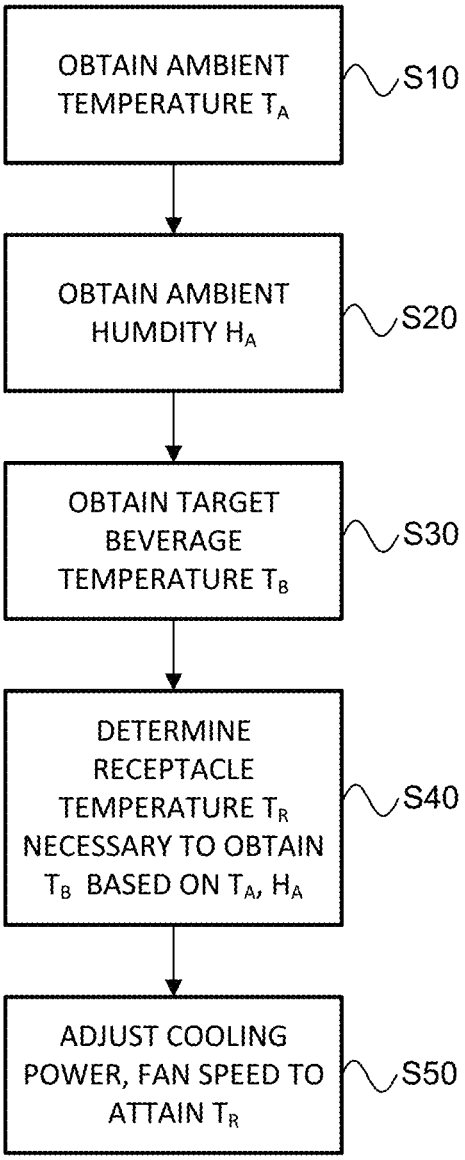
FIG. 8 is a flow chart of a procedure for controlling operation of a beverage container temperature control system according to one aspect of an embodiment.

Referring now to FIG. 8, a procedure for controlling operation of the beverage container temperature control system according to one aspect of embodiment will now be described. In a step S10, the ambient temperature is obtained using, for example, the sensor 280 described above located on the housing (FIG. 2). Then in a step S20 the ambient humidity is obtained also from a sensor, for example, located on the housing. Note that these steps may be performed in either order. In step S30 a target beverage temperature is obtained. again, this step may be performed in any order with respect to steps S10 and S20. Step S30 may be performed by the system simply assuming that every beverage has the same target temperature. As an alternative, however, the system could detect or be provided with information on what beverage is being chilled and be provided with a target temperature for that particular beverage. Note that it could also be a step here of determining how much beverage is actually in the container if a sensor is provided for making that determination. In a step S40 the receptacle temperature that is necessary to obtain the target beverage temperature is then determined based at least in part on the ambient temperature and ambient humidity (and perhaps also amount of beverage). This step may be performed, for example, by reference to a look up table, by using an application specific integrated circuit, field programmable gate array, or by computation. Then, in a step S50, one or both of the cooling power or fan speed are adjusted to attain the desired receptacle temperature.

Thus, described herein is a beverage container temperature control system with exemplary embodiments having a generally cylindrical configuration. According to an aspect of an embodiment, heavier electronic components are positioned towards the bottom of the beverage container temperature control system to give the beverage container temperature control system an overall low center of gravity. According to one aspect of an embodiment, the bottom portion of the beverage container temperature control system has a fan, a heat sink, and a Peltier cooler. It may also include provision for gyroscopic stabilization. The fan is arranged so as to expel warm air. Ambient air is drawn into an around the heat sink at a separate location from where warm air is expelled downward from the fan in a 360 degree ring. There is a parting wall between the hot air exhaust portion and the cold air intake. Ambient air is drawn in through the front and rear of the heat sink. In some embodiments, the inside wall of the beverage container temperature control system is in thermal communication with the cold side of the Peltier element and functions as a cold sink.

According to another aspect of an embodiment, the beverage container temperature control system is supplied with various temperature sensors. For example, there may be a temperature sensor at the top end of the interior cold sink to indicate the temperature at that point. Similar temperature sensors could be positioned at the middle, that is, halfway up the beverage container temperature control system or the middle of the cold sink and at the bottom end of the cold sink. The beverage container temperature control system can also include sensors on an outside casing to measure ambient temperature, humidity, light intensity, wind speed, and atmospheric pressure. As indicated, there may also be a temperature sensor at heat sink and there may be a temperature sensor at the air inlet.

For some applications, it may be desirable to avoid the use of a fan at all. For such applications, the inner portion of the device may be adapted to function as a cold sink in thermal contact with the cold side of the Peltier element. The outer casing may then be arranged to act as a heat sink. Heat pipes can be placed in the outer casing to promote better heat transfer. A vacuum may be maintained between the inner the walls of the inner chamber and the outside walls in order to reduce heat flow between the cold sink and the heat sink.

According to another aspect of an embodiment, the outer casing may be provided with fins to promote better heat transfer between the outer casing acting as a heat sink and the ambient air.

In accordance with another aspect of an embodiment, the beverage container temperature control system is dimensioned to have a diameter of at least 120 millimeters. This is to ensure the ability to use a large fan to obtain to avoid the use of a noisy, smaller fan. The inner diameter may be about 105 millimeters to accommodate the majority of wine bottles.

The beverage container temperature control system may be provided with a digital touch control system place on the bottom part of the beverage container temperature control system and not on the main body to ensure that the beverage container temperature control system is not actuated by accident when moving the beverage container temperature control system or a bottle within the beverage container temperature control system.

In an embodiment, the beverage container temperature control system has a round circular configuration to promote air to air intake and outflow while limiting the space that must be dedicated to this aspect of its operation.

In accordance with another aspect of an embodiment, batteries are placed in the lower portion of the beverage container temperature control system to provide for a low center of gravity. In other words, the heavier components are placed in the bottom portion of the beverage container temperature control system with a lighter, passive top portion of the beverage container temperature control system. In accordance with another aspect of aspect of embodiment, the air inlet and outlet are angled to prevent liquids from contaminating the electronic and electric components housed in the base of the unit. Inner rubber pads may be provided on the inside cold plate to prevent damage to bottles or to limit noise production when the bottle comes into contact with the walls when moving the beverage container temperature control system handle or handling the bottle. According to another aspect of an embodiment, a three sensor cold plate system is used to ensure an even temperature distribution and thermal transfer to the bottle and to avoid imparting thermal stresses to the bottle. A slanted top promotes access to the bottle and an integrated handle structure facilitates handling of the beverage container temperature control system.

In accordance with another aspect of an embodiment, a barcode or label scanner can be integrated to recognize the wine that is being placed into the beverage container temperature control system to automatically set the optimal temperature for that variety of wine.

The beverage container temperature control system can be provided with wireless telecommunication capability to connect with wine databases in order to obtain data about wines which could be displayed on a handheld smart phone, iPad, or other smart device. The device may include a memory which will contain data on the optimal settings for different varieties of wine. The device can include provision for an Internet of Things connection for smartphone operation or data retrieval. The device could communicate with wine merchants and wineries to provide them with information on when and how and where people are consuming their products.

In accordance with another aspect of an embodiment, a sensor may be included to detect how much wine is in the bottle. A procedure can be used to use all available data on the surrounding editions to compute the optimal $\Delta T$ for cooling. In accordance with another aspect of an embodiment, the beverage container temperature control system can include a presence sensor to detect when a bottle is in the beverage container temperature control system to shut off the cooler when the bottle is removed or not present after certain delay in order to preserve battery power. The integral carrying handle ensures robustness and easy transport. According to other aspects of an embodiment, a touch display is provided for setting the temperature. The touch display can just be an LED display capable of displaying different temperatures with different colors indicating different temperature ranges. Placement of the touch display in the bottom part rather than the main body of the cooler prevents interference with and isolation of the main body and minimizes touching the display area when carrying the unit or removing a bottle or placing from the unit or placing a bottle in the unit. The fan outlet is arranged to avoid sucking intake of dirt or other particulate matter that may be on a surface on which the unit has been placed. The unit may accommodate a Bluetooth speaker in its bottom part as well. The unit may be charging plate compatible and be compatible with external battery packs to provide the option of prolonged operation with an external battery pack. The unit could also be provided with a power mode where it can provide enhanced cooling operation when connected to line power. The insulation may include a phase change material.

The above description includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is construed when employed as a transitional word in a claim. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. Apparatus for controlling a temperature of a beverage container, the apparatus comprising:

a housing having an upper portion and a lower portion, the upper portion including a receptacle adapted to receive the beverage container;

a thermoelectric element positioned in the lower portion, the thermoelectric element having a first side at a first temperature and a second side at a second temperature lower than the first temperature, the second side being in thermal communication with the receptacle;

a heat sink in thermal communication with the first side;

at least one battery positioned in the lower portion and electrically connected to the thermoelectric element to provide power to the thermoelectric element; and a fan arranged in the housing;

wherein the lower portion includes air outlets at a base of the lower portion and air inlets all positioned above and separated from the air outlets by a barrier and wherein the fan is arranged to draw air in through the air inlets, force the air through the heat sink and exhaust the air passed through the heat sink out through the air outlets in a 360° ring.

2. The apparatus as claimed in claim 1 wherein the lower portion of the housing includes a temperature display.

3. The apparatus as claimed in claim 1 further comprising at least one temperature sensor for measuring at least one measured temperature in the receptacle.

4. The apparatus as claimed in claim 3 wherein the lower portion of the housing includes a temperature display displaying the at least one measured temperature.

5. The apparatus as claimed in claim 1 wherein the apparatus further comprises a detector arranged to detect a characteristic of a container placed in the receptacle and wherein the apparatus selects the second temperature based on the characteristic.

6. The apparatus as claimed in claim 1 further comprising a volume detector arranged to detect a detected volume of liquid in a container inserted into the cradle and an indicator adapted to provide an indication of the detected volume.

7. The apparatus as claimed in claim 1 further comprising a temperature detector arranged to detect a detected temperature of the container and an indicator adapted to provide an indication of the detected temperature.

8. The apparatus as claimed in claim 1 further comprising a communications module arranged to receive control data from an external device.

9. The apparatus as claimed in claim 1 further comprising a touch sensitive sensor for imputing control data.

10. The apparatus as claimed in claim 1 further comprising a sensor for sensing a temperature in the receptacle at a mid-level location.

11. The apparatus as claimed in claim 1 further comprising a sensor provided to sense the temperature of incoming air to the heat sink.

12. The apparatus as claimed in claim 1 further comprising a sensor provided on the housing to measure at least one of ambient temperature, humidity, light intensity, wind speed, and atmospheric pressure.

13. The apparatus as claimed in claim 1 further comprising a phase change material between the receptacle and the housing.

14. The apparatus as claimed in claim 1 further comprising a tip tilt detection sensor arranged to detect tipping or tilting of the housing.

15. The apparatus as claimed in claim 1 further comprising a gyroscopic stabilizer mechanically coupled to the housing and positioned to cause the housing to tend to remain upright.

16. The apparatus as claimed in claim 1 further comprising a communication interface including a device for communicating data to or from the apparatus and an outside device.

17. Apparatus for controlling a temperature of a beverage container, the apparatus comprising:

a cylindrical housing having an upper portion and a lower portion, the upper portion including a cylindrical receptacle adapted to receive the beverage container, the cylindrical housing having a slanted upper rim defining a raised portion and an integral handle in the raised portion;

a thermoelectric element positioned in the lower portion, the thermoelectric element having a first side at a first temperature and a second side at a second temperature lower than the first temperature, the second side being in thermal communication with the receptacle;

a heat sink in thermal communication with the first side;

a fan arranged to ventilate the heat sink and positioned in the lower portion; and at least one battery positioned in the lower portion and electrically connected to the thermoelectric element to provide power to the thermoelectric element and the fan, wherein the lower portion includes air outlets at a base of the lower portion and air inlets all positioned above and separated from the air outlets by a barrier and wherein the fan is arranged to draw air in through the air inlets, force the air through the heat sink and exhaust the air passed through the heat sink out through the air outlets in a 360° ring.

18. Apparatus for controlling a temperature of a beverage container, the apparatus comprising:

a cylindrical housing having an upper portion and a lower portion, the upper portion including a cylindrical receptacle adapted to receive the beverage container, the cylindrical housing having a slanted upper rim defining a raised portion and an integral handle in the raised portion;

a thermoelectric element positioned in the lower portion, the thermoelectric element having a first side at a first temperature and a second side at a second temperature lower than the first temperature, the second side being in thermal communication with the receptacle, the cylindrical housing comprising heat sink in thermal communication with the first side;

at least one battery positioned in the lower portion and electrically connected to the thermoelectric element to provide power to the thermoelectric element, wherein the cylindrical housing comprises a plurality of heat radiating fins positioned parallel to an axis of the cylindrical housing and wherein the lower portion includes air outlets at a base of the lower portion and air inlets all positioned above and separated from the air outlets by a barrier and wherein the fan is arranged to draw air in through the air inlets, force the air through the heat sink and exhaust the air passed through the heat sink out through the air outlets in a 360° ring.

* * * * *